US006029689A

United States Patent [19]

Arai et al.

[11] Patent Number: 6,029,689

[45] Date of Patent: Feb. 29, 2000

[54] COUNTER BALANCE VALVE

[75] Inventors: Mitsuru Arai, Oyama; Hiroshi Endo, Tochigi-ken, both of Japan

[73] Assignee: Komatsu Ltd., Japan

[21] Appl. No.: 09/174,603

[22] Filed: Oct. 19, 1998

[30] Foreign Application Priority Data

Oct. 27, 1997 [JP] Japan ..... 9-294061

[51] Int. Cl.[7] ..... F15B 13/04

[52] U.S. Cl. ..... 137/106; 91/420

[58] Field of Search ..... 91/420; 137/106

[56] References Cited

U.S. PATENT DOCUMENTS 5,113,894 5/1992 Yoshida ..... 91/420 X

*Primary Examiner*—Gerald A. Michalsky
*Attorney, Agent, or Firm*—Greer, Burns & Crain, Ltd.

[57] ABSTRACT

A communication area of a left pressure reception chamber, a pressure reception chamber, a right pressure reception chamber and another pressure reception chamber for moving a spool to first and second positions with a first pump port and a second pump port is made large at the beginning of a stroke, small at the intermediate of the stroke and medium at the end of the stroke so as to return the spool from the first and second positions to the neutral position in a short time while preventing cavitation from occurring. While the volume of the pressure reception chamber located opposite to the moving direction of the spool is prevented from changing, the spool is moved slowly in the above-described opposite direction. Thus, the spool is prevented from making an over-stroke and also prevented from having a hunching even if a return pressure oil has a large change in pressure.

2 Claims, 11 Drawing Sheets

COUNTER BALANCE VALVE

BACKGROUND OF THE INVENTION

1. Field of the Invention

The present invention relates to a counter balance valve, and more particularly to a counter balance valve mounted on a driving hydraulic circuit or the like of an oil hydraulic motor for a running unit of a construction machine.

2. Description of the Related Art

For example, a known driving hydraulic circuit of the oil hydraulic motor is shown in FIG. 11. In this driving hydraulic circuit, discharge passage la of an oil hydraulic pump 1 is connected to first main circuit 3 and second main circuit 4 through an operation valve 2. First main circuit 3 and second main circuit 4 are respectively connected to first port $\mathbf{6}_1$ and second port $\mathbf{6}_2$ of oil hydraulic motor 5. Counter balance valve 7 is disposed between first main circuit 3 and second main circuit 4.

In such a driving hydraulic circuit, when operation valve 2 is in neutral position N, counter balance valve 7 also falls in neutral position N, circuits of first and second main circuits 3, 4 which are closer to oil hydraulic motor 5 than check valves 8 of first and second main circuits 3, 4 are closed to prevent oil hydraulic motor 5 from being rotated by an external force.

Where operation valve 2 is set to first position (1) or second position (2), a pressure oil is supplied to either of first or second main circuits 3, 4, and counter balance valve 7 is switched to first position A or second position B by the pressure oil.

Counter balance valve 7 used for the driving hydraulic circuit is switched to first position A as the high pressure oil of first main circuit 3 acts on left pressure reception chamber 7*a*, and also switched to second position B as the high pressure oil of second main circuit 4 acts on right pressure reception chamber 7*b*. As a result, either of second or first main circuit 4, 3 is connected to tank 9 through counter balance valve 7.

On the other hand, when the high pressure oil is removed, counter balance valve 7 is pushed toward neutral position by springs 7*c* so to return to neutral position N while discharging the oil from left pressure reception chamber 7*a* or right pressure reception chamber 7*b*.

When oil hydraulic motor 5 is to be stopped, it is rotated by inertia to make pumping.

Therefore, when oil hydraulic motor 5 is stopped with operation valve 2 at neutral position N, counter balance valve 7 immediately comes to neutral position N, and either of first port $\mathbf{6}_1$ and second port $\mathbf{6}_2$ rapidly becomes a high pressure, resulting in having a large shock when oil hydraulic motor 5 is stopped.

In order to decrease a shock when oil hydraulic motor 5 is stopped, a speed of returning counter balance valve 7 from first position A or second position B to neutral position N may be decreased. In other words, the pressure oil in first port $\mathbf{6}_1$ and second port $\mathbf{6}_2$ may be discharged into tank 9 by closing counter balance valve 7, so that the shock involved in stopping oil hydraulic motor 5 can be decreased. For example, as to counter balance valve 7 described above, chokes 11, 11 are respectively mounted on circuit 10 which connects left pressure reception chamber 7*a* with first main circuit 3 and another circuit 10 connecting right pressure reception chamber 7*b* with second main circuit 4. Thus, the oil is discharged slowly from left pressure reception chamber 7*a* and right pressure reception chamber 7*b* by decreasing opening areas chokes 11, 11. As a result, counter balance valve 7 is made to slowly return from first position A or second position B to neutral position N, and the shock involved in stopping oil hydraulic motor 5 can be decreased.

However, the above configuration makes the counter balance valve 7 takes a longer time to return to neutral position N. Therefore, it takes a lot of time before oil hydraulic motor 5 stops completely. At this time, because relief valve for recirculating from first port $\mathbf{6}_1$ to second port $\mathbf{6}_2$ does not open, a flow rate becomes insufficient due to suction from tank toward lower pressure side, a cavitation may occur.

In order to solve such a conflicting problem of a shock at the high-pressure side and a cavitation at the low-pressure side, a counter balance valve is described in Japanese Patent Application Laid-Open No. 1-101708. FIG. 12 shows this counter balance valve.

The counter balance valve 7 maintains a spool in the neutral position by a spring 7*c*. The left pressure reception chamber 7*a* is communicated with a first pump port 12 and shifts the spool to the first position A when the pressure oil supplied. The right pressure reception chamber 7*b* is communicated with a second pump port 13 and shifts the spool to the second position B when the pressure oil is supplied.

A passage from the first pump port 12 to the left pressure reception chamber 7*a* and a passage from the second pump port 13 to the right pressure reception chamber 7*b* respectively have a first choking hole 14, a second choking hole 15 and a third choking hole 16.

In this counter balance valve 7, for example when the spool moves from the first position A to the neutral position N, at the beginning of a stroke to the intermediate position, the pressure oil in the left pressure reception chamber 7*a* flows smoothly to the first pump port 12 through the first choking hole 14 and the second choking hole 15 (a large communication area). When the spool has stroked to the intermediate position N, the pressure oil in the left pressure reception chamber 7*a* flows through the first choking hole 14 (a small communication area) only. When the spool further strokes, it is designed that the pressure oil in the left pressure reception chamber 7*a* flows through the first choking hole 14 and the third choking hole 16 (an intermediate communication area). The same is also applied when the spool is moved from the second position B to the neutral position N.

In this counter balance valve 7, the moving speed from the first position A or the second position B to the neutral position N is high at the beginning of a stroke, low at the middle of the stroke and intermediate at the end of the stroke. As a result, the counter balance valve 7 allows to return to the neutral position N in a short time while preventing cavitation from occurring.

Accordingly, the counter balance valve 7 mounted on the driving hydraulic circuit of the oil hydraulic motor 5 makes it possible to decelerate to stop the oil hydraulic motor 5 in a short time while preventing cavitation from occurring.

When a pressure in the left pressure reception chamber 7*a* drops and the spool is moved from the first position A to the neutral position N by the spring force, the counter balance valve 7 has the left pressure reception chamber 7*a* communicated with the first pump port 12 through the first choking hole 14 (a small communication area) at the middle of the stroke described above. During which the right pressure reception chamber 7*b* is kept communicated with the second pump port 13 through the first choking hole 14 and the third choking hole 16. In other words, the communication area between the right pressure reception chamber 7*b* and the second pump port 13 is identical with the intermediate communication area communicating between the left pressure reception chamber 7*a* and the first pump port 12 at the end of the stroke.

Thus, when the counter balance valve 7 is continuously used with the spool at the middle position of the stroke as described above, an effect of preventing vibrations while the spool moves from the first position A to the neutral position N is enhanced when the running unit of a construction machine is going downhill, for example.

However, when the spool is moved from the neutral position N toward the first position A, the pressure oil of the right pressure reception chamber 7*b* flows smoothly to the second pump port 13, hence a vibration preventing effect is lowered. As a result, an over-stroke of the spool may be caused when the spool moves toward the first position A.

For this reason, a drive torque of the oil hydraulic motor 5 is varied due to the road irregularities during running down hill and thus a pressure change of the return pressure oil of the oil hydraulic motor 5 becomes large, the spool is moved because the vibration prevention effect of the spool is small and a change in the opening area between the pump port 12, 13 and the motor port 17,18 becomes large. As a result, it may cause a change (hunching) in the rotating speed of the oil hydraulic motor 5 or a scratching-like movement, that is, an irregular speed change of the oil hydraulic motor 5.

The same thing is also caused when the spool is moved from the second position B to the neutral position N.

SUMMARY OF THE INVENTION

Under the circumstances, it is an object of the present invention to provide a counter balance valve, which can return a spool to the neutral position in a short time with cavitation prevented from occurring and without involving a shock.

It is also an object of the invention to provide a counter balance valve, which can prevent a spool from varying in case that the pressure of a pressure oil applied to a pump port is largely varied.

A first aspect of the invention relates to a counter balance valve, which comprises:

a spool, which is moved to a neutral position to shut off a first pump port from a first motor port and to shut off a second pump port from a second motor port, a first position to shut off the first pump port from the first motor port and to communicate the second pump port with the second motor port, and a second position to communicate the first pump port with the first motor port and to shut off the second pump port from the second motor port;

springs, which maintain the spool in the neutral position;

a left chamber, where the spool is moved from the neutral position toward the first position;

a right chamber, where the spool is moved from the neutral position toward the second position;

a first communication area switching section, which changes a communication area of the left chamber with the first pump port; and a second communication area switching section, which changes a communication area of the right chamber with the second pump port; wherein:

the communication area of the first communication area switching section is large at a start of a stroke when the spool is moved from the first position toward the neutral position, small at a middle of the stroke, medium at an end of the stroke, and intermediate between small and medium when the spool is moved from the neutral position to the second position; and the communication area of the second communication area switching section is large at the start of a stroke when the spool is moved from the second position toward the neutral position, small at the middle of the stroke, medium at the end of the stroke, and intermediate between small and medium when the spool is moved from the neutral position to the first position.

According to the first aspect of the invention, when the spool 26 is moved from the first position A to the neutral position N, the communication area of the left chamber with the first pump port 22 is large at the beginning of the stroke, small at the middle of the stroke and intermediate at the end of the stroke. And, when the spool 26 is moved from the second position B toward the neutral position N, the communication area of the right chamber with the second pump port 23 is large at the start of the stroke, small at the intermediate of the stroke and medium at the end of the stroke.

Thus, when the spool 26 is moved from the first position A or the second position B toward the neutral position, a traveling speed of the spool 26 is high at the start of the stroke, low at the middle of the stroke and medium at the end of the stroke. As a result, the spool 26 can be returned to the neutral position quickly while preventing cavitation from occurring.

Accordingly, when the counter balance valve of the first aspect of the invention is applied to the driving hydraulic circuit of an oil hydraulic motor, it is possible to decelerate the oil hydraulic motor without causing a shock while preventing the occurrence of cavitation and stop the oil hydraulic motor in a short period of time.

Further, when the spool 26 is moved from the neutral position N toward the first position A, the communication area of the right chamber with the second pump port 23 has an intermediate size between small and medium. And when the spool 26 is moved from the neutral position N toward the second position B, the communication area of the left chamber with the first pump port 22 has an intermediate size between small and medium.

Therefore, when the spool 26 is at the middle of the stroke to move from the first position A or the second position B to the neutral position N, if the drive force of the oil hydraulic motor is varied by an external force for example to largely change the pressure of the pressure oil returning to the second motor port 25 or the first motor port 24, the spool 26 is moved slowly toward or to return from the neutral position N and does not make an over-stroke. As a result, even if the return pressure oil has a large change in its pressure, the spool 26 does not cause a hunching, and the oil hydraulic motor can rotate smoothly.

Accordingly, when the counter balance valve according to the first aspect of the invention is applied to the driving hydraulic circuit of an oil hydraulic motor, it is possible to prevent a hunching (a change in revolutions) and a scratching-like movement, that is, an irregular speed change of the oil hydraulic motor.

A second aspect of the invention relates to the counter balance valve according to claim 1, wherein:

the left chamber comprises a pressure reception chamber and a left pressure reception chamber which are formed on the left side of the spool, a volume of the pressure reception chamber increases when the spool is moved from the neutral position to the first position, decreases when the spool is moved from the first position to the neutral position, but does not change when the spool is moved from the neutral position to the second position and from the second position to the neutral position;

the left pressure reception chamber is communicated with the first pump port through second and third chokes when the spool is moved from the first position to a stroke position ($L_2$) toward the neutral position, through the third choke when the spool is moved from the stroke position ($L_2$) to a stroke position ($L_1$) and through a first choke and the third choke when the spool is moved from the stroke position ($L_1$) to the neutral position, and the pressure reception chamber is communicated with the first pump port 22 through a fourth choke to configure the first communication area switching section;

the right chamber comprises the pressure reception chamber and a right pressure reception chamber which are formed on the right side of the spool, a volume of the pressure reception chamber increases when the spool is moved from the neutral position to the second position, decreases when the spool is moved from the second position to the neutral position but does not change when the spool is moved from the neutral position to the first position and from the first position to the neutral position;

the right pressure reception chamber is communicated with the second pump port through the second and third chokes when the spool is moved from the second position to a stroke position ($-L_2$) toward the neutral position, through the third choke when the spool is moved from the stroke position ($-L_2$) to a stroke position ($-L_1$) and through the first choke and the third choke when the spool is moved from the stroke position ($-L_1$) to the neutral position, and the pressure reception chamber is communicated with the second pump port through the fourth choke to configure the second communication area switching section; and when it is assumed that the first, second, third and fourth chokes have opening areas $A_1$, $A_2$, $A_3$ and $A_4$ respectively, they are expressed as follows:

$$(A_2+A_3+A_4)>(A_1+A_3+A_4)>(A_1+A_3>(A_3+A_4).$$

According to the second aspect of the invention, the volume of the right pressure reception chamber 32 does not changed when the spool 26 is moved from the neutral position N toward the first position A and from the first position A toward the neutral position N. And the volume of the left pressure reception chamber 32 does not change when the spool 26 is moved from the neutral position N toward the second position B and from the second position B toward the neutral position N.

Thus, when the spool 26 is moved from the neutral position N toward the first position A, the fourth choke 42 on the right side does not work. And when the spool 26 is moved from the neutral position N toward the second position B, the fourth choke 42 on the left side does not work.

Accordingly, the communication between the left pressure reception chamber 28 and the first and second chokes 38, 39 on the left side and between the right pressure reception chamber 29 and the first and second chokes 38, 39 on the right side is established or cut off by the moving spool 26. Therefore, its configuration can be made simple.

DESCRIPTION OF THE PREFERRED EMBODIMENTS

Figure 1:
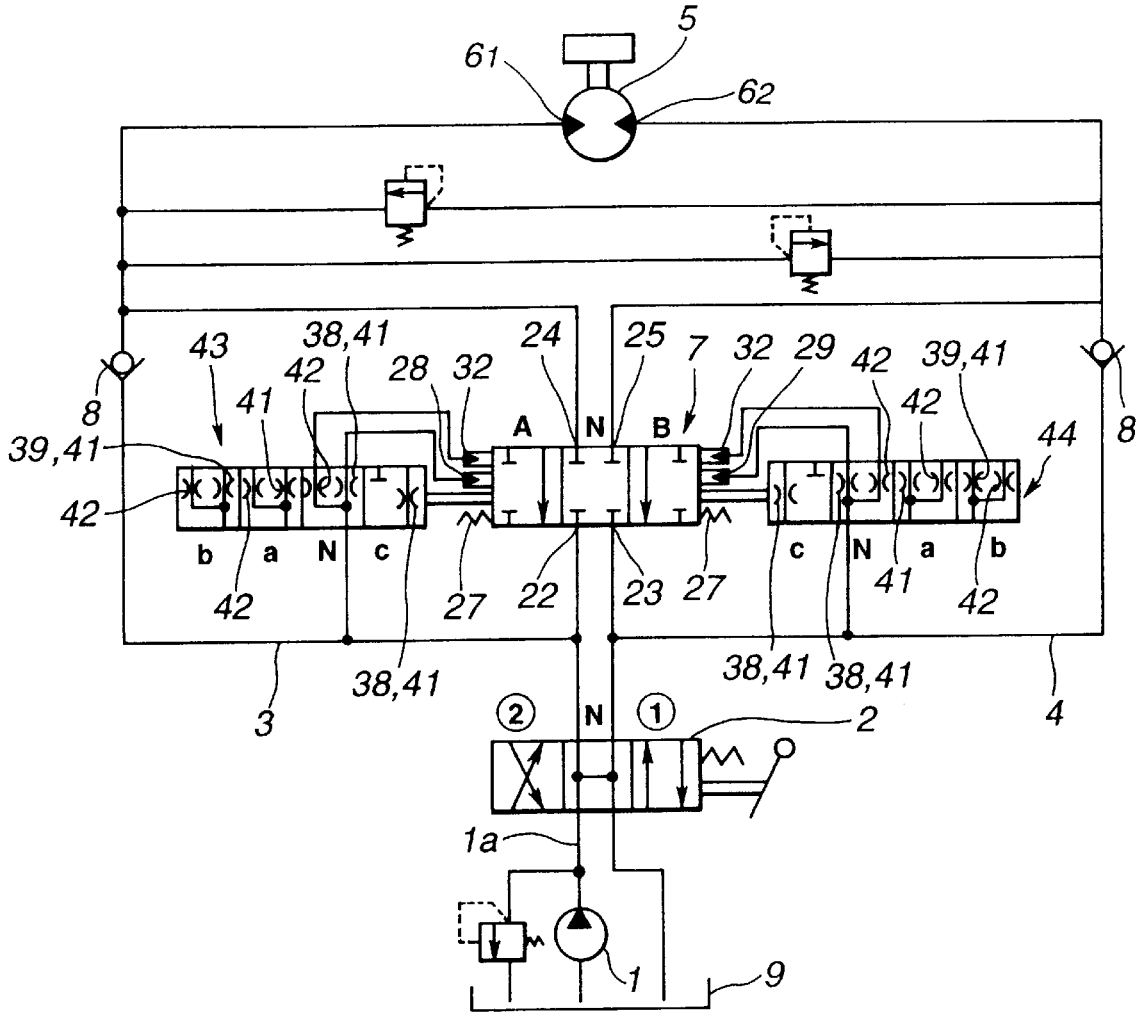
FIG. 1 is an explanatory diagram schematically showing the configuration of an embodiment of the invention.
Figure 11:
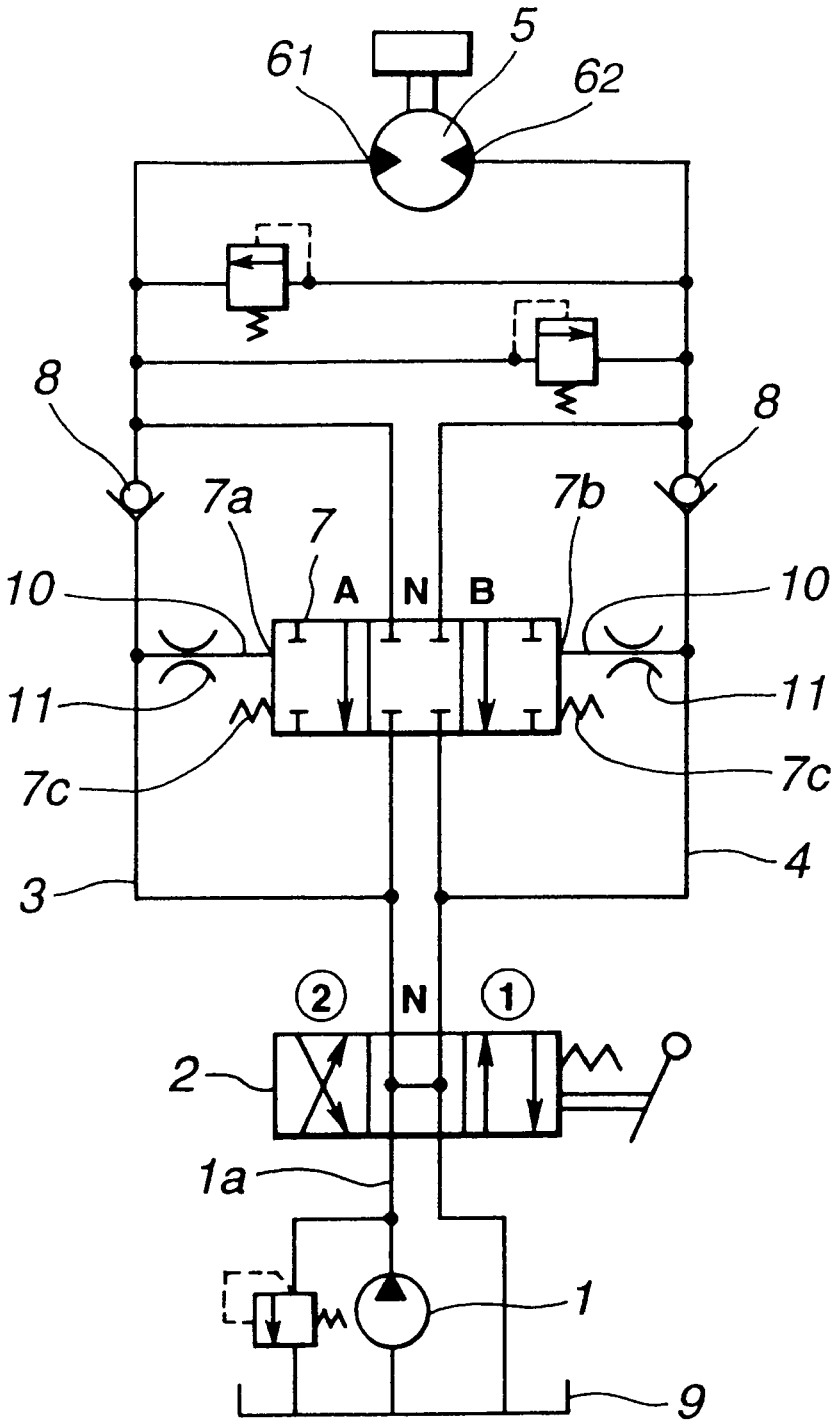
FIG.11 (PRIOR ART)
FIG. 11 is a circuit diagram of a prior art.
Figure 12:
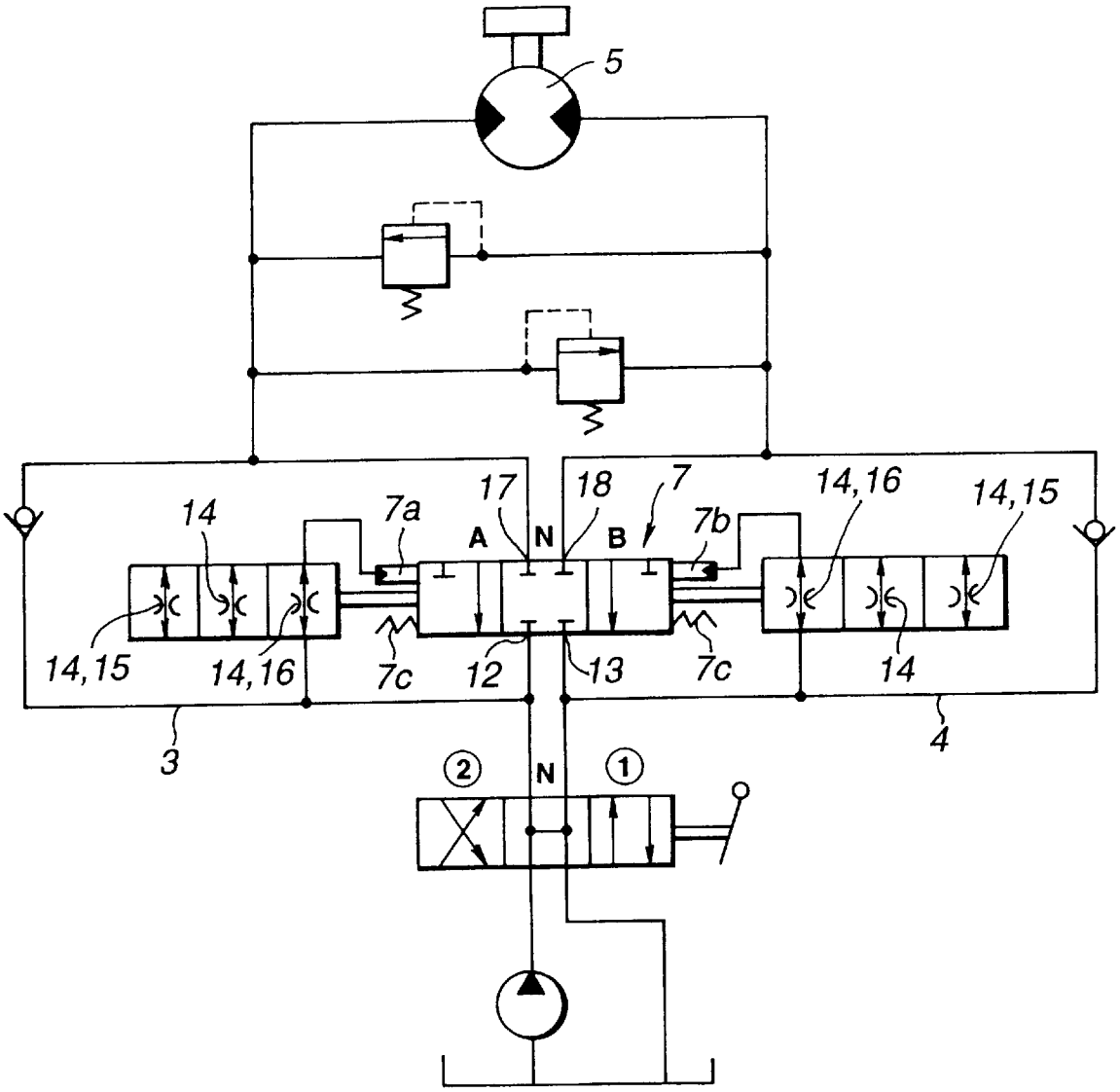
FIG.12 (PRIOR ART)
FIG. 12 is a circuit diagram of a prior art.

A driving hydraulic pressure circuit diagram of an oil hydraulic motor shown in FIG. 1 is the same as a driving hydraulic circuit diagram shown in FIG. 11 excepting that counter balance valve 7 is different.

Figure 2:
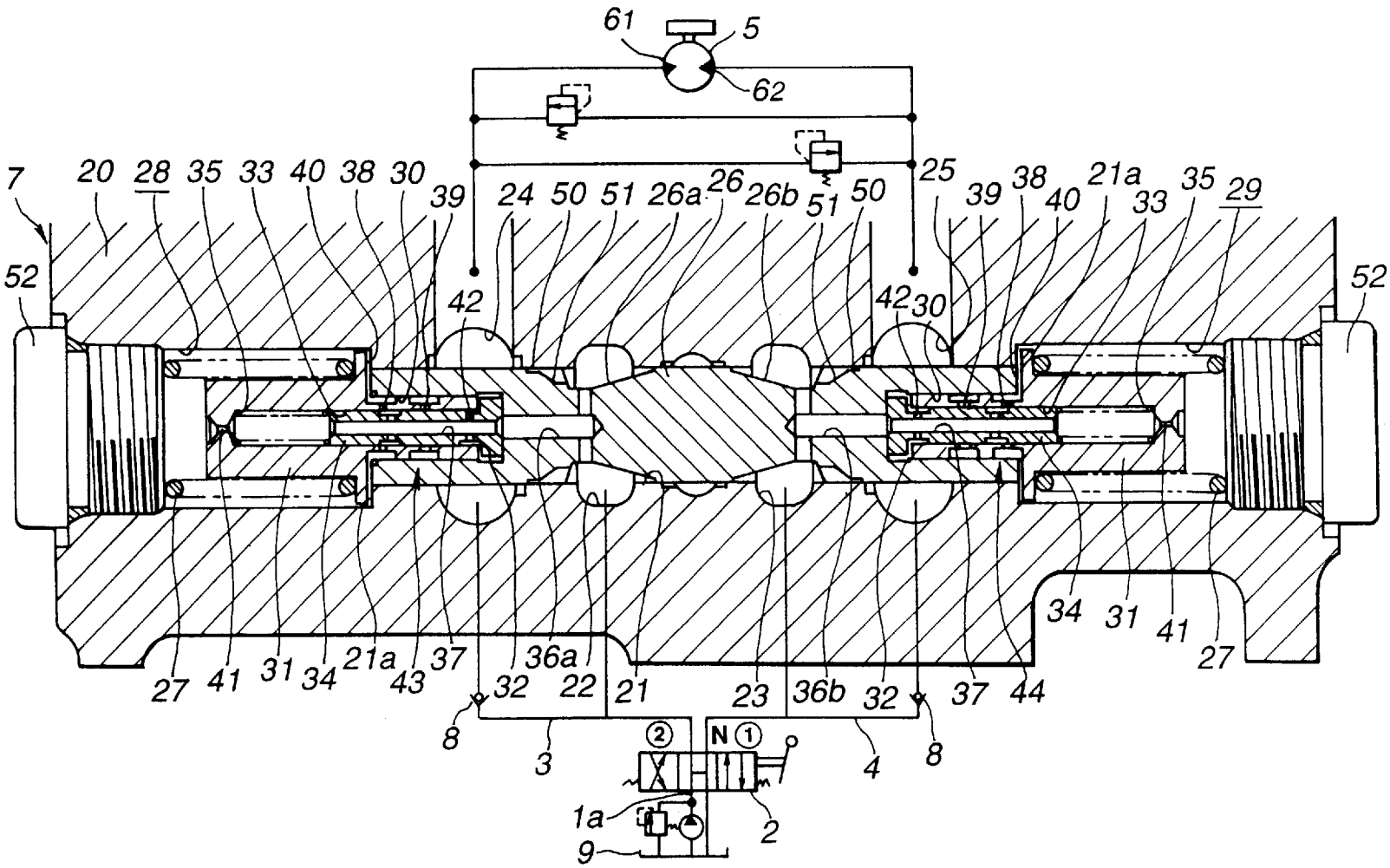
FIG. 2 is a sectional diagram specifically showing the shape of a counter balance valve of the embodiment of the invention.

Counter balance valve 7 has valve body 20 as shown in FIG. 2.

Valve hole 21 is formed on valve body 20. First and second pump ports 22, 23 and first and second motor ports 24, 25 are formed in valve hole 21. The respective ports are communicated or interrupted by spool 26 which is slidably inserted into valve hole 21. Spool 26 is held in neutral position N by a pair of springs 27, 27. Spool 26 is slid toward first position A by a hydraulic force of left pressure reception chamber 28 and also toward second position B by a hydraulic force of right pressure reception chamber 29.

Piston hole 30 is formed on right and left sides of spool 26. First pistons 31 are respectively fitted into these piston holes 30 to form pressure reception chamber 32 for moving spool 26 from neutral position N to first position A and another pressure reception chamber 32 for moving spool 26 to second position B. Each first piston 31 is kept in contact with step 21*a* of spool port 21 by spring 27. Second piston 34 is fitted into piston hole 33 of each first piston 31. Each second piston 34 is maintained in position by auxiliary spring 35 as shown in FIG. 2.

Left pressure reception camber 28 and pressure reception chamber 32 on the left side form a left chamber for moving spool 26 from neutral position N to first position A. And, right pressure reception chamber 29 and pressure reception chamber 32 on the right side form a right chamber for moving spool 26 from neutral position N to second position B.

Figure 3:
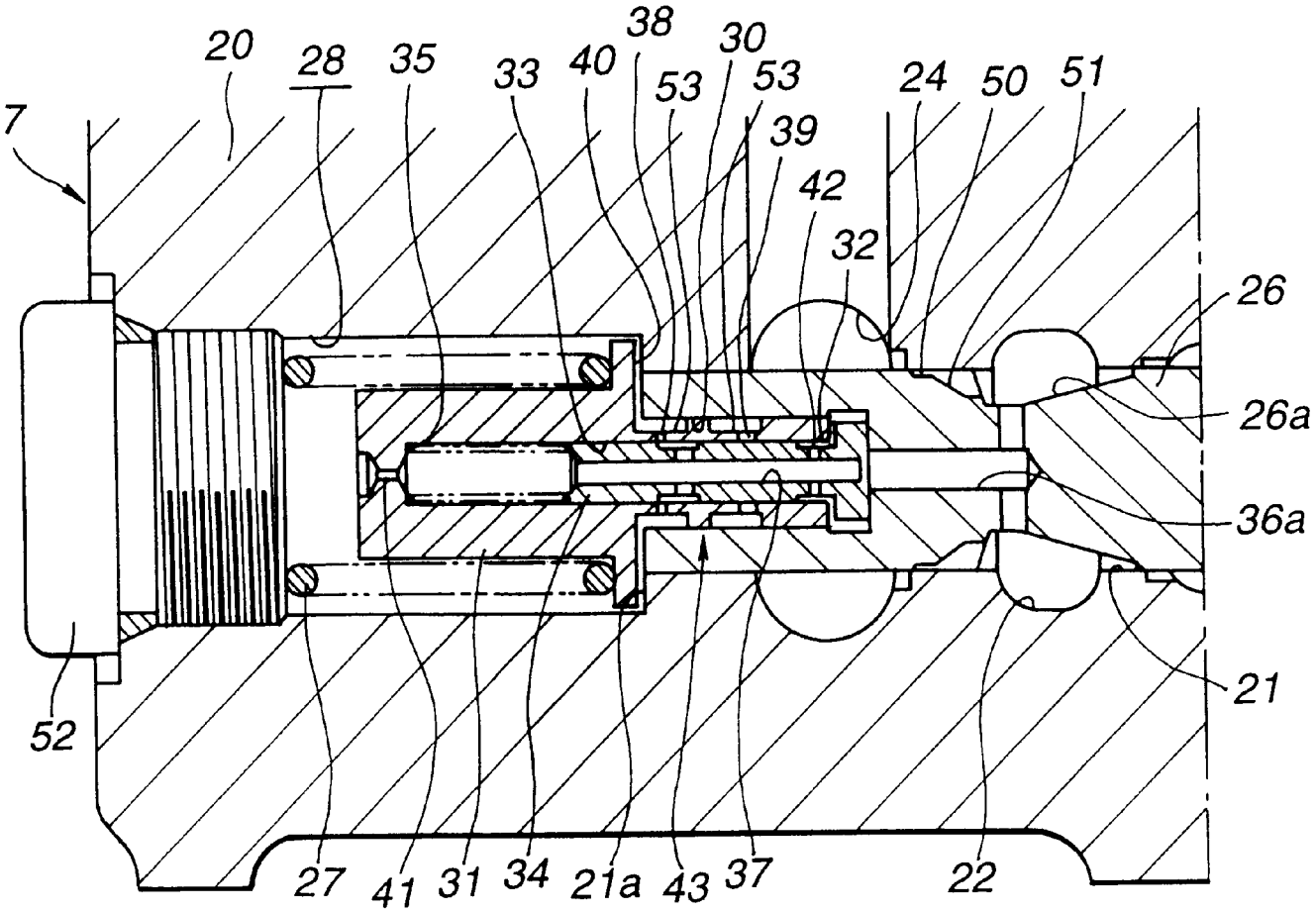
FIG. 3 is an enlarged sectional diagram of the left half section of the counter balance valve shown in FIG. 2.

First pump port 22 is communicated with shaft hole 37 of second piston 34 on the left side through first small diameter section 26*a* of spool 26 and first oil hole 36*a* as shown in FIG. 3. Shaft hole 37 is communicated with and shut off from left pressure reception chamber 28 through first choke 38, second choke 39 and slit 40 of first piston 31 as spool 26 moves. Shaft hole 37 is communicated with left pressure reception chamber 28 through third choke 41 of first piston 31 and with pressure reception chamber 32 of first piston 31 to form first communication area switching section 43.

Figure 4:
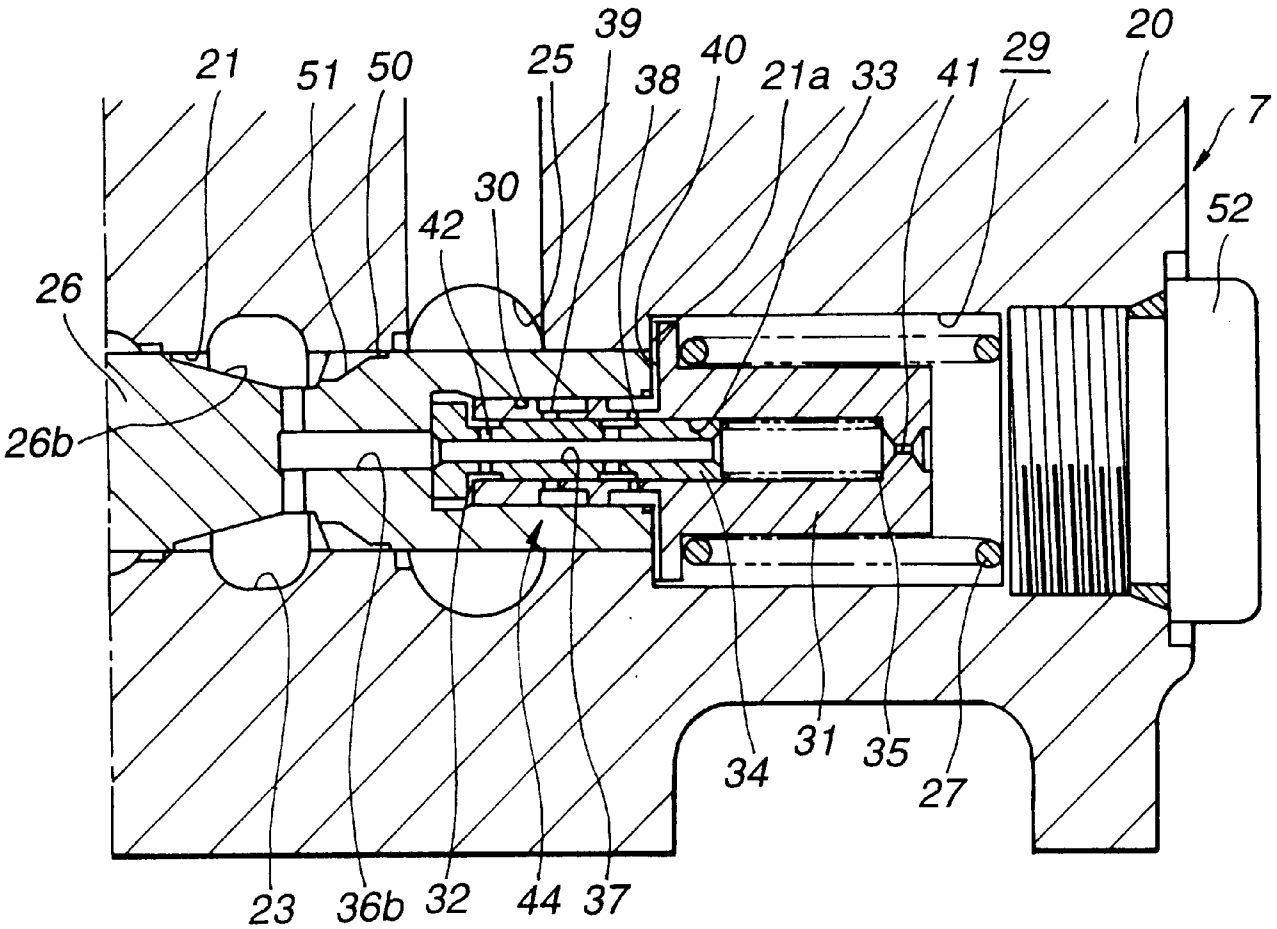
FIG. 4 is an enlarged sectional diagram of the right half section of the counter balance valve shown in FIG. 2.

Second pump port 23 is communicated with shaft hole 37 of second piston 34 on the right side through second small diameter section 26*b* of spool 26 and second oil hole 36*b* as shown in FIG. 4. Shaft hole 37 is communicated with and shut off from right pressure reception chamber 29 through first choke 38, second choke 39 and slit 40 of first piston 31 as spool 26 moves. Shaft hole 37 is communicated with right pressure reception chamber 29 through third choke 41 of first piston 31 and with pressure reception chamber 32 of first piston 31 through fourth choke 42 to form second communication area switching section 44.

A specific configuration of counter balance valve 7 and its operation will be described.

When operation valve 2 is in neutral position N and spool 26 of counter balance valve 7 is in the neutral position shown in FIG. 2, first pump port 22 and first motor port 24 are shut off from each other, and second pump port 23 and second motor port 25 are also shut off from each other.

Left pressure reception chamber 28 is communicated with shaft hole 37 through slit 40, first choke 38 and third choke 41 and also with first pump port 22 through first oil hole 36*a* and first small diameter section 26*a*. Pressure reception chamber 32 of first piston 31 on the side of left pressure reception chamber 28 is communicated with first pump port 22 through fourth choke 42, shaft hole 37, first oil hole 36*a* and first small diameter section 26*a*.

On the other hand, right pressure reception chamber 29 is communicated with shaft hole 37 through slit 40, first choke 38 and third choke 41 and with second pump port 23 through second oil hole 36*b* and second small diameter section 26*b*. And, pressure reception chamber 32 of first piston 31 on the side of right pressure reception chamber 29 is communicated with second pump port 23 through fourth choke 42, shaft hole 37, second oil hole 36*b* and second small diameter section 26*b*.

Therefore, when spool 26 of counter balance valve 7 is in the neutral position (counter balance valve 7 is in neutral position N), left pressure reception chamber 28 is communicated with first pump port 22 with the opening area of (an opening area of first choke 38+ an opening area of third choke 41), and pressure reception chamber 32 is communicated with first pump port 22 with the opening area of fourth choke 42. And, right pressure reception chamber 29 is communicated with second pump port 23 with the opening area of (an opening area of first choke 38+ an opening area of third choke 41), and pressure reception chamber 32 is communicated with second pump port 23 with the opening area of fourth choke 42.

The state described above is schematically shown in FIG. 1. In other words, both first and second communication area switching sections 43, 44 are in neutral position N.

Starting from the state described above, operation valve 2 is set to first position (1) to supply the pressure oil to first main circuit 3, and second main circuit 4 is communicated with tank 9. Then, the pressure oil is supplied to first port $\mathbf{6}_1$ to have a high pressure in first main circuit 3 and a tank pressure in second main circuit 4. As a result, spool 26 of counter balance valve 7 is moved to the right by the high pressure oil in left pressure reception chamber 28 and the high pressure oil in pressure reception chamber 32.

Figure 5:
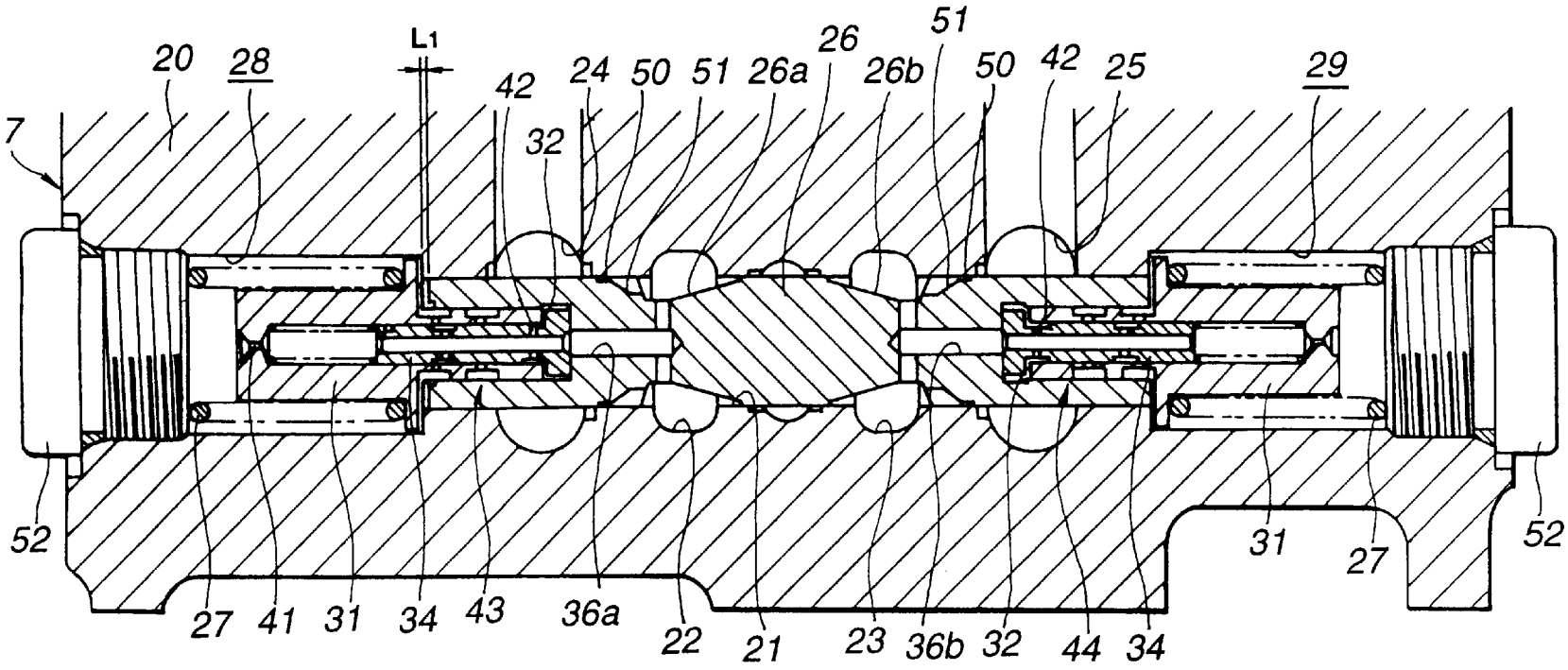
FIG. 5 is a sectional diagram showing a state that a spool is moved by stroke $L_1$.

When spool 26 is moved to the right by stroke $L_1$ as shown in FIG. 5, second piston 34 is moved to the right toward first piston 31 by stroke $L_1$ together with spool 26 to shut off first choke 38 from shaft hole 37. As a result, left pressure reception chamber 28 is communicated with first pump port 22 through third choke 41 only.

Namely, first communication area switching section 43 shown in FIG. 1 falls in a state of first communication position a.

Figure 6:
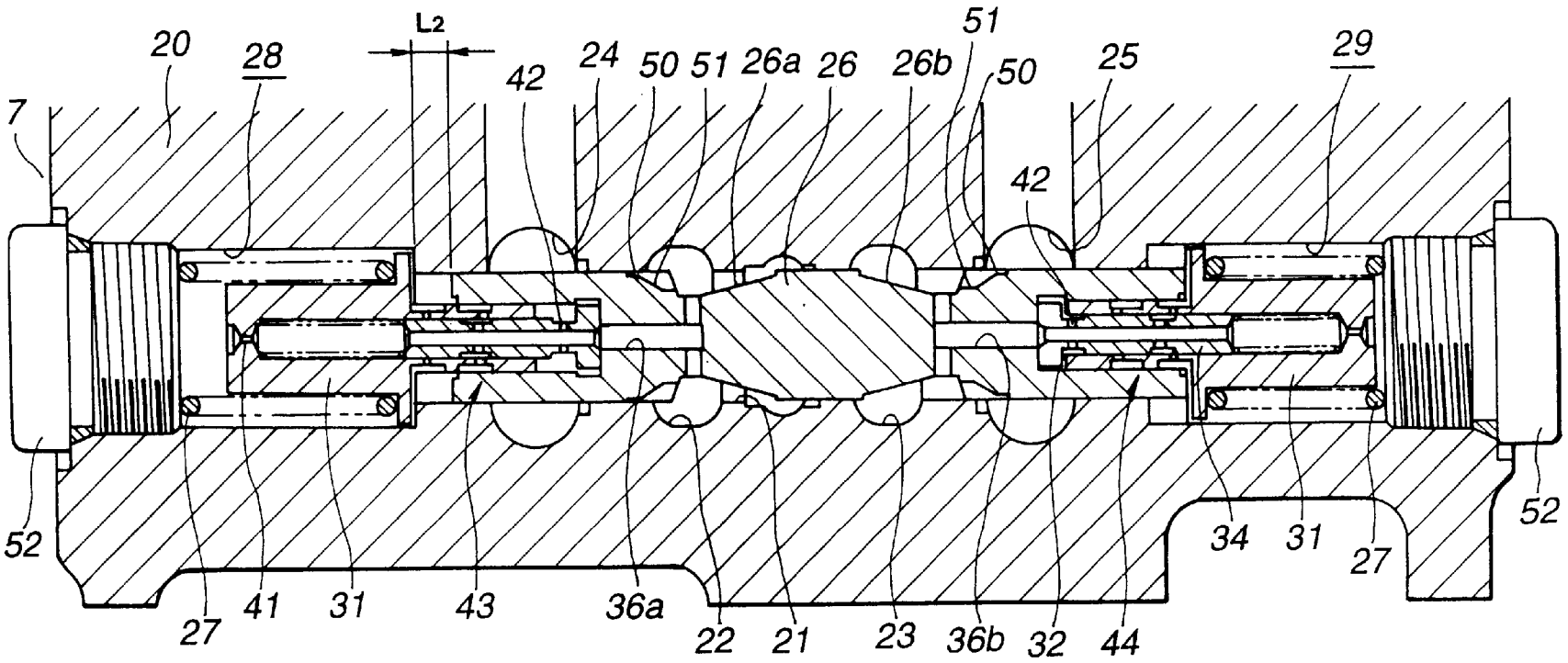
FIG. 6 is a sectional diagram showing a state that the spool has moved by stroke $L_2$.

Spool 26 is further moved to the right by stroke $L_2$ ($L_2$>L) as shown in FIG. 6 to communicate shaft hole 37 with left pressure reception chamber 28 through second choke 39. As a result, the high-pressure oil flows from first pump port 22 into left pressure reception chamber 28 through the opening area (the opening area of second choke 39 and the opening area of third choke 41).

In other words, first communication area switching section 43 shown in FIG. 1 falls in a state of second communication position b.

When spool 26 is further moved to the right, second pump port 23 and second motor port 25 are mutually communicated with the maximum communication area, and spool 26 falls in first position A.

As described above, when spool 26 is moved from neutral position N to first position A, the communication area between left pressure reception chamber 28 and first pump port 22 is a sum of the opening area of first choke 38 and that of third choke 41 when spool 26 has stroke $L_1$ and the opening area of third choke 41 when spool 26 is moved from stroke $L_1$ to stroke $L_2$. And, the high-pressure oil is always supplied from first pump port 22 to pressure reception chamber 32 through fourth choke 42.

Figure 7:
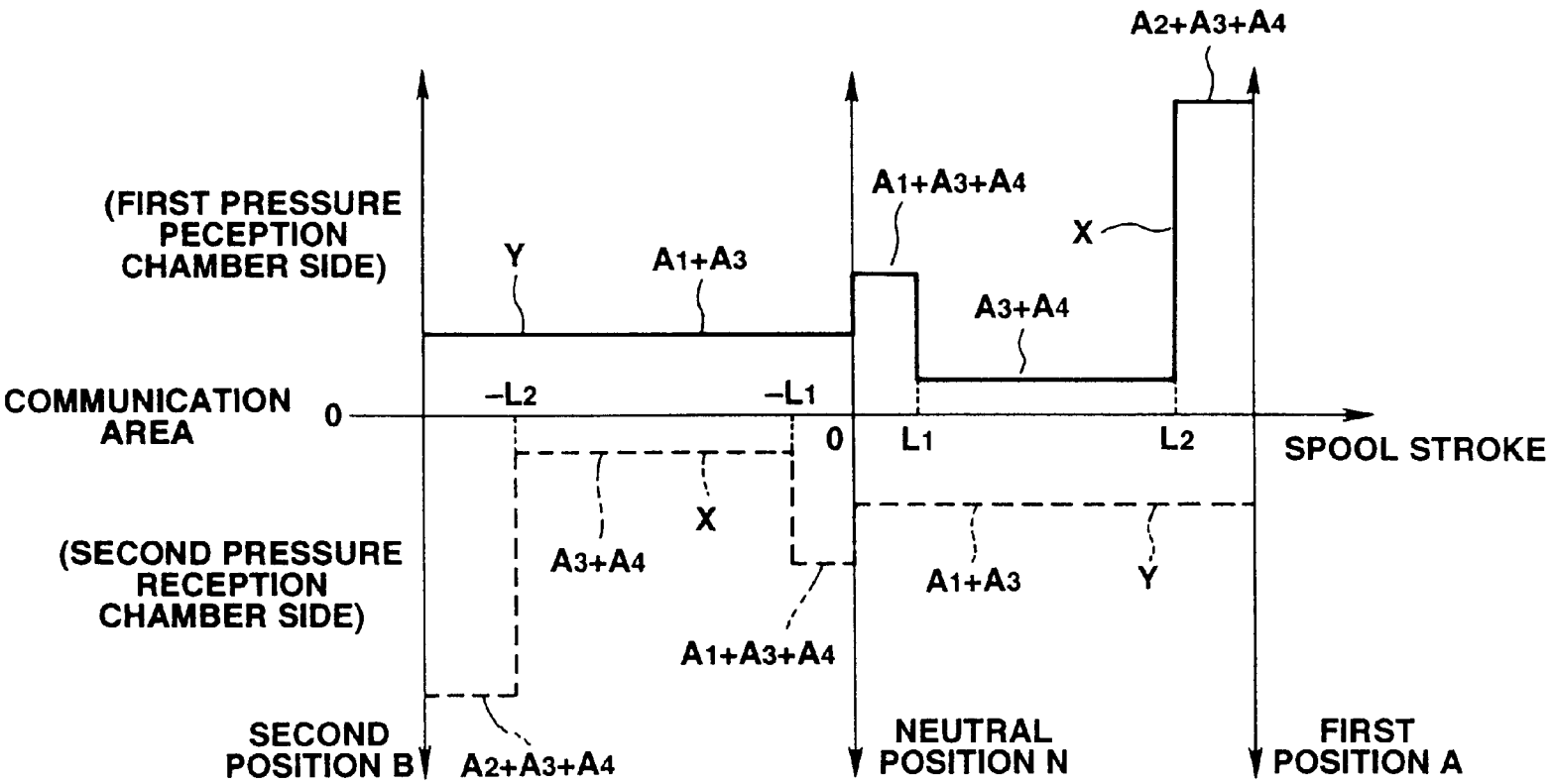
FIG. 7 is a diagram showing a relation between a spool stroke and a communication area of a pressure reception chamber and a pump port.

Therefore, when counter balance valve 7 is moved from neutral position N to first position A, the area communicating the left chambers (first pressure reception chamber 28, pressure reception chamber 32) and first pump port 22 (first main circuit 3) on which the high-pressure oil acts is indicated by solid line X in FIG. 7.

Specifically, the opening area is (opening area $A_1$ of first choke 38+ opening area $A_3$ of third choke 41+opening area $A_4$ of fourth choke 42) when spool 26 is moved by stroke $L_1$, (opening area $A_3$ of third choke 41+opening area $A_4$ of fourth choke 42) when it is moved from stroke $L_1$ to stroke $L_2$, and (opening area $A_2$ of second choke 39+opening area $A_3$ of third choke 41+opening area $A_4$ of fourth choke 42) when it is moved from stroke $L_2$ to the end of the stroke (first position A).

And, it is determined to be $(A_2+A_3+A_4)>(A_1+A_3+A_4)>(A_3+A_4)$.

When spool 26 is moved from the neutral position to first position A, first piston 31 and second piston 34 of right pressure reception chamber 29 are moved to the right by spool 26, so that these three components are in the same positional relation as they were in the neutral position. Therefore, right pressure reception chamber 29 is always communicated with second pump port 23 with the communication area of (opening area $A_1$ of first choke 38+opening area $A_3$ of third choke 41), and the volume of pressure reception chamber 32 does not change. Namely, second communication area switching section 43 of FIG. 1 is always in a state of third communication position c.

Thus, when spool 26 of counter balance valve 7 is moved from the neutral position to first position A, the communication area between right pressure reception chamber 29 and second pump port 23 is $(A_1+A_3)$ as indicated by dotted line Y in FIG. 7, where $(A_1+A_3)$ is larger than $(A_3+A_4)$.

In the above description, a first area of spool 26 on which the high-pressure oil of left pressure reception chamber 28 acts is larger than a second area of spool 26 on which the high-pressure oil of pressure reception chamber 32 acts. Accordingly, a flow rate through fourth choke 42 when spool 26 is moved is smaller than the flow rate through other chokes. Therefore, the opening area of fourth choke 42 can not be compared directly with the opening area of another choke. Therefore, the opening area of fourth choke 42 has a value resulting from multiplying its opening area with the ratio a of the first area to the second area. Multiplication of the area ratio a is not required if the first area and the second area have the same size or a very small difference.

Area ratio a is $D_1^2/(D_2^2-D_3^2)$. $D_1$ is a diameter of spool 26, $D_2$ is a diameter of piston hole 30, and $D_3$ is a diameter of second piston 34.

Now, spool 26 moving from first position A to neutral position N will be described.

By switching operation valve 2 from first position (1) to neutral position N, spool 26 is moved toward the neutral position by the return pressure oil of oil hydraulic motor 5 and spring 27, the pressure oil of left pressure reception chamber 28 and the pressure oil of pressure reception chamber 32 are discharged into first pump port 22.

When spool 26 is moved from first position A to stroke $L_2$ (namely the start of the stroke), the communication area of first pump port 22 with left pressure reception chamber 28 and with pressure reception chamber 32 is large to $(A_2+A_3+A_4)$, and spool 26 is moved quickly.

When spool 26 is moved from stroke $L_2$ to stroke $L_1$ (namely, middle stroke), the communication area of first pump port 22 with left pressure reception chamber 28 and with pressure reception chamber 32 is small to $(A_3+A_4)$, and spool 26 is moved slowly.

When spool 26 is moved from stroke $L_1$ to neutral position N (namely, the end of the stroke), the communication area of first pump port 22 with left pressure reception chamber 28 and with pressure reception chamber 32 is intermediate to $(A_1+A_3+A_4)$, so that spool 26 is moved at an intermediate speed.

And, when spool 26 is moved from first position A to neutral position N, the communication area of right pressure reception chamber 29 with second motor port 25 is $(A_1+A_3)$, which is an intermediate value between the above-described small and intermediate communication areas. And, the pressure oil of right pressure reception chamber 29 is hard to discharged into second motor port 25.

Thus, when spool 26 is in the intermediate of the stroke and the return pressure oil of hydraulic motor 5 is lowered to move spool 26 toward first position A, the pressure oil in right pressure reception chamber 29 flows slowly. As a result, spool 26 is moved slowly toward first position A and does not make an over-stroke in a direction of first position A.

Therefore, a hunching does not occur in spool 26, and as a result, a hunching (a change in rotating speed) or a scratching-like movement, that is, an irregular speed change does not occur in oil hydraulic motor 5.

The same procedure is applied when spool 26 in second position B is moved to neutral position N. Namely, the communication area of second pump port 23 with right pressure reception chamber 29 and with pressure reception chamber 32 is variable to $(A_1+A_3+A_4)$, $(A_3+A_4)$ and $(A_2+A_3+A_4)$ as indicated by dotted line X in FIG. 7. And, the communication area of left pressure reception chamber 28 with first motor port 24 is $(A_1+A_3)$ as indicated by solid line Y in FIG. 7.

First notch 50 and second notch 51 are successively formed in an axial direction on first small diameter section 26*a* and second small diameter section 26*b* of spool 26. Therefore, when spool 26 is moved from neutral position N to first position A, the communication area of second pump port 23 with second motor port 25 is small at the start of the stroke and then becomes large sharply.

Figure 8:
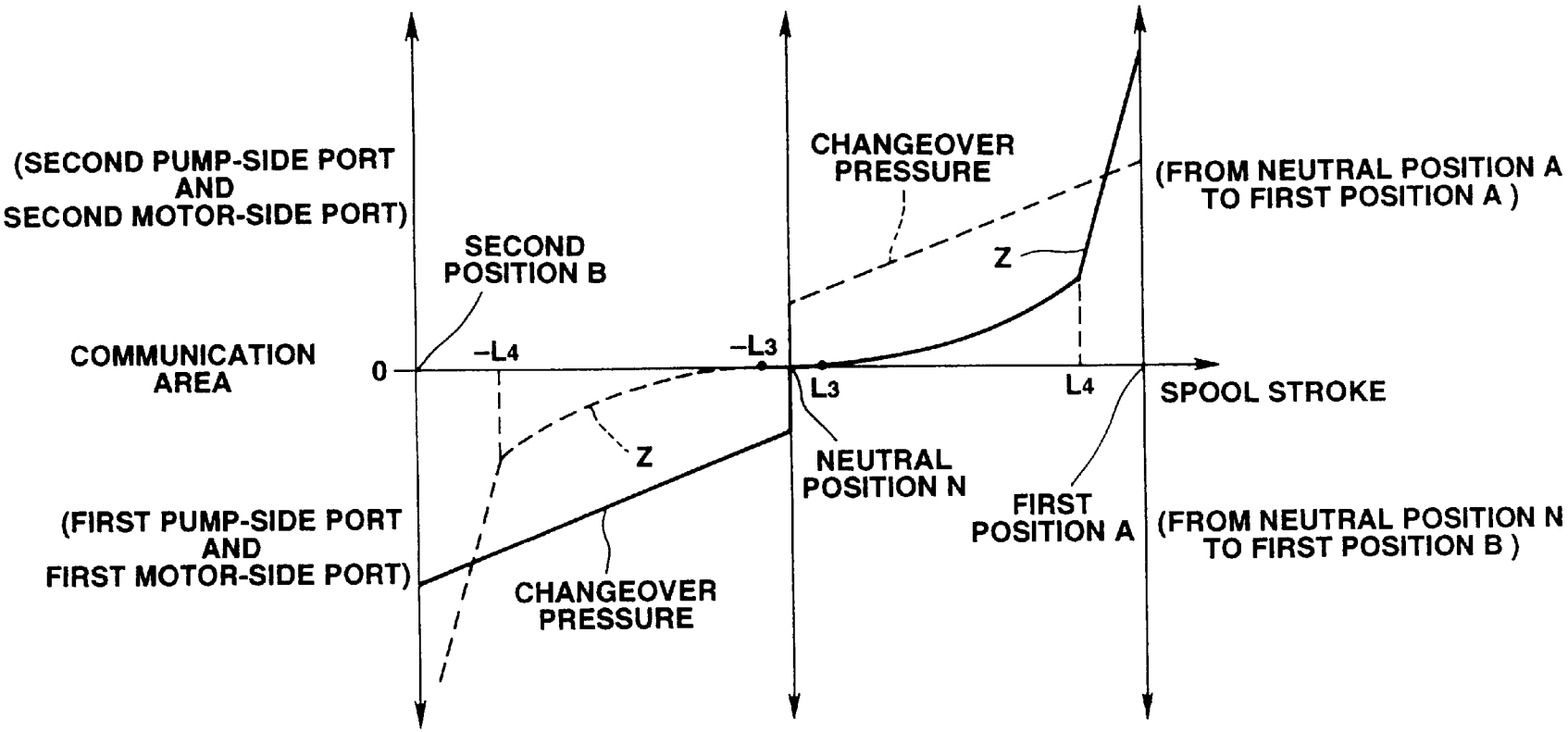
FIG. 8 is a diagram showing a relation among a communication area of a pump port and a motor port, a changeover pressure and a spool stroke.

For example, when communication is started from stroke $L_3$ as indicated by solid line Z in FIG. 8, and the communication area is escalated up to stroke $L_4$ and then sharply increased on and after stroke $L_4$. At this time, the switching pressure (pressure of left pressure reception chamber 28) is shown at the upper right part of FIG. 8.

When spool 26 is moved from neutral position N toward second position B, the communication area of first pump port 22 with first motor port 24 is also the same as indicated by dotted line Z in FIG. 8. Besides, the switching pressure (pressure in right pressure reception chamber 29) at this time is shown at the lower left part of FIG. 8.

Right and left first pistons 31 are moved only when spool 26 is moved toward first position A or second position B and, when spool 26 is moved in the opposite direction, they are in contact with step 21*a* of spool hole 21 and not moved. Therefore, piston hole 30 of spool 26 is short in length. In addition, plug 52 to be a spring receiver does not require drilling. Annular grooves 53 are formed on the outer surface of first piston 31 so to eliminate the necessity of forming an annular groove on the inner surface of piston hole 30 of spool 26.

Such combination facilitates fabrication of spool 26 and plug 52.

Figure 9:
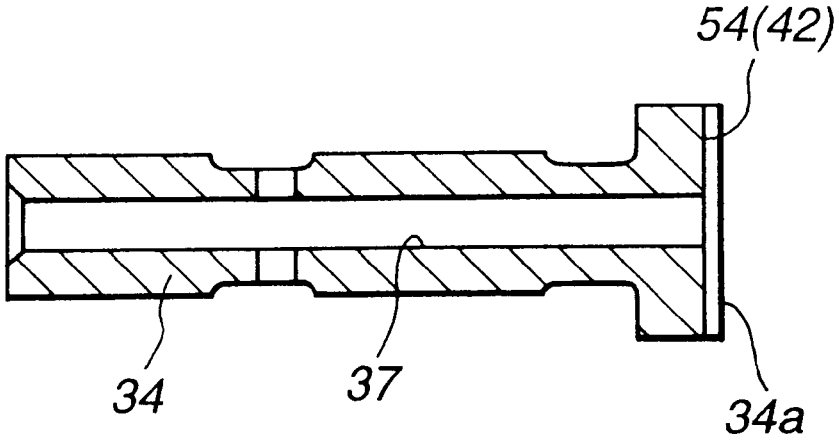
FIG. 9 is a sectional diagram showing another example of the piston shown in FIG. 2.
Figure 10:
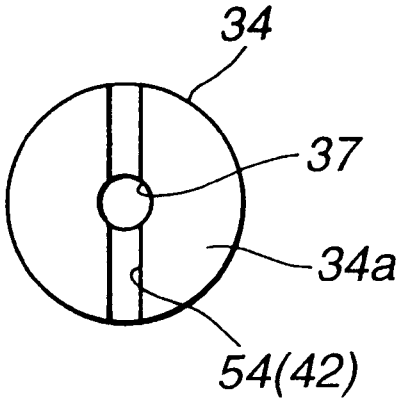
FIG. 10 is a right side view of FIG. 9.

Fourth choke 42 of second piston 34 has a small hole, but slit 54 may be formed in a radial direction on end face 34*a* of second piston 34 so to serve as fourth choke 42 as shown in FIG. 9 and FIG. 10.

What is claimed is:

1. A counter balance valve, comprising:

a spool, which is moved to a neutral position to shut off a first pump port from a first motor port and to shut off a second pump port from a second motor port, a first position to shut off the first pump port from the first motor port and to communicate the second pump port with the second motor port, and a second position to communicate the first pump port with the first motor port and to shut off the second pump port from the second motor port;

springs, which maintain the spool in the neutral position;

a left chamber, where the spool is moved from the neutral position toward the first position;

a right chamber, where the spool is moved from the neutral position toward the second position;

a first communication area switching section, which changes a communication area of the left chamber with the first pump port; and a second communication area switching section, which changes a communication area of the right chamber with the second pump port; wherein:

the communication area of the first communication area switching section is large at a start of a stroke when the spool is moved from the first position toward the neutral position, small at a middle of the stroke, medium at an end of the stroke, and intermediate between small and medium when the spool is moved from the neutral position to the second position; and the communication area of the second communication area switching section is large at the start of a stroke when the spool is moved from the second position toward the neutral position, small at the middle of the stroke, medium at the end of the stroke, and intermediate between small and medium when the spool is moved from the neutral position to the first position.

2. The counter balance valve according to claim 1, wherein:

the left chamber comprises a pressure reception chamber and a left pressure reception chamber which are formed on the left side of the spool, a volume of the pressure reception chamber increases when the spool is moved from the neutral position to the first position, decreases when the spool is moved from the first position to the neutral position, but does not change when the spool is moved from the neutral position to the second position and from the second position to the neutral position;

the left pressure reception chamber is communicated with the first pump port through second and third chokes when the spool is moved from the first position to a stroke position ($L_2$) toward the neutral position, through the third choke when the spool is moved from the stroke position ($L_2$) to a stroke position ($L_1$) and through a first choke and the third choke when the spool is moved from the stroke position ($L_1$) to the neutral position, and the pressure reception chamber is communicated with the first pump port 22 through a fourth choke to configure the first communication area switching section;

the right chamber comprises the pressure reception chamber and a right pressure reception chamber which are formed on the right side of the spool, a volume of the pressure reception chamber increases when the spool is moved from the neutral position to the second position, decreases when the spool is moved from the second position to the neutral position, but does not change when the spool is moved from the neutral position to the first position and from the first position to the neutral position;

the right pressure reception chamber is communicated with the second pump port through the second and third chokes when the spool is moved from the second position to a stroke position ($-L_2$) toward the neutral position, through the third choke when the spool is moved from the stroke position ($-L_2$) to a stroke position ($-L_1$) and through the first choke and the third choke when the spool is moved from the stroke position ($-L_1$) to the neutral position, and the pressure reception chamber is communicated with the second pump port through the fourth choke to configure the second communication area switching section; and when it is assumed that the first, second, third and fourth chokes have opening areas $A_1$, $A_2$, $A_3$ and $A_4$ respectively, they are expressed as follows:

$$(A_2+A_3+A_4)>(A_1+A_3+A_4)>(A_1+A_3>(A_3+A_4).$$

* * * * *